US009514910B2

(12) United States Patent
Yanagisawa et al.

(10) Patent No.: US 9,514,910 B2
(45) Date of Patent: Dec. 6, 2016

(54) RADIATION TUBE, RADIATION GENERATING APPARATUS, AND RADIATION IMAGING SYSTEM

(71) Applicant: CANON KABUSHIKI KAISHA, Tokyo (JP)

(72) Inventors: Yoshihiro Yanagisawa, Fujisawa (JP); Kazuhiro Sando, Atsugi (JP); Koichi Tsunoda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 14/592,041

(22) Filed: Jan. 8, 2015

(65) Prior Publication Data

US 2015/0201482 A1 Jul. 16, 2015

(30) Foreign Application Priority Data

Jan. 16, 2014 (JP) ..... 2014-005602

(51) Int. Cl.

| | |
|---|---|
| ***H01J 35/08*** | (2006.01) |
| ***H01J 35/06*** | (2006.01) |
| ***H01J 35/18*** | (2006.01) |
| ***H01J 35/20*** | (2006.01) |
| ***H05G 1/06*** | (2006.01) |

(52) U.S. Cl.

CPC ..... *H01J 35/08* (2013.01); *H01J 35/18* (2013.01); *H01J 35/20* (2013.01); *H05G 1/06* (2013.01); *H01J 2235/166* (2013.01); *H01J 2235/186* (2013.01); *H01J 2235/205* (2013.01)

(58) Field of Classification Search

CPC ..... H01J 35/08; H01J 35/06; H01J 35/02; H01J 35/04; H01J 5/18; H05G 1/06; H05G 1/04; H05G 1/02; H05G 1/58; H05G 1/70

USPC ..... 378/140, 122, 111, 119, 121, 134, 136

See application file for complete search history.

(56) References Cited

U.S. PATENT DOCUMENTS

| | | | | |
|---|---|---|---|---|
| 6,882,703 | B2 * | 4/2005 | Price | H01J 35/065 378/101 |
| 8,139,716 | B2 * | 3/2012 | Okunuki | H01J 35/065 378/122 |
| 8,208,603 | B2 * | 6/2012 | Sato | H01J 35/06 378/119 |
| 8,666,024 | B2 * | 3/2014 | Okunuki | A61B 6/00 378/124 |
| 8,837,680 | B2 * | 9/2014 | Tsujii | H01J 35/08 378/140 |
| 9,048,058 | B2 * | 6/2015 | Yamazaki | H01J 35/02 |
| 9,058,958 | B2 * | 6/2015 | Aoki | H01J 35/04 |
| 9,076,627 | B2 * | 7/2015 | Yanagisawa | H01J 35/16 |
| 9,101,039 | B2 * | 8/2015 | Ikarashi | H05G 1/58 |
| 9,111,655 | B2 * | 8/2015 | Ohashi | A61B 6/06 |
| 9,159,525 | B2 * | 10/2015 | Yamazaki | H01J 35/06 |

(Continued)

FOREIGN PATENT DOCUMENTS

| | | |
|---|---|---|
| JP | H07134959 A | 5/1995 |
| JP | 2003203591 A | 7/2003 |

(Continued)

*Primary Examiner* — David A Vanore

(74) *Attorney, Agent, or Firm* — Fitzpatrick, Cella, Harper & Scinto

(57) ABSTRACT

In a radiation tube, a conductive member having an opening formed therein is disposed, and a dielectric is disposed in the conductive member. Thus, foreign matter that has entered the conductive member through the opening is trapped by the dielectric. As a result, discharge due to foreign matter can be reduced.

12 Claims, 5 Drawing Sheets

(56) References Cited

U.S. PATENT DOCUMENTS

| | | | | |
|---|---|---|---|---|
| 9,177,753 | B2 * | 11/2015 | Yamazaki | H01J 35/16 |
| 9,251,995 | B2 * | 2/2016 | Ogura | G01N 23/04 |
| 9,281,155 | B2 * | 3/2016 | Ueda | H01J 35/18 |
| 9,281,158 | B2 * | 3/2016 | Ogura | H01J 35/18 |
| 9,373,478 | B2 * | 6/2016 | Tamura | H01J 35/12 |
| 2010/0266097 | A1 * | 10/2010 | Okunuki | A61B 6/032 378/9 |
| 2012/0307974 | A1 * | 12/2012 | Yamazaki | H01J 35/06 378/62 |
| 2013/0016810 | A1 * | 1/2013 | Tamura | H01J 35/12 378/62 |
| 2013/0016811 | A1 * | 1/2013 | Ueda | H05G 1/025 378/62 |
| 2013/0016812 | A1 | 1/2013 | Yanagisawa et al. | |
| 2013/0034207 | A1 | 2/2013 | Aoki et al. | |
| 2013/0129045 | A1 * | 5/2013 | Ogura | H01J 5/18 378/62 |
| 2014/0140486 | A1 | 5/2014 | Yanagisawa et al. | |
| 2014/0153695 | A1 | 6/2014 | Yanagisawa et al. | |
| 2014/0177796 | A1 * | 6/2014 | Sato | H01J 35/16 378/62 |
| 2014/0270083 | A1 * | 9/2014 | Dinsmore | H01J 35/025 378/109 |
| 2014/0362974 | A1 | 12/2014 | Yanagisawa et al. | |
| 2014/0369467 | A1 | 12/2014 | Yamazaki et al. | |
| 2014/0369470 | A1 | 12/2014 | Ukiyo et al. | |
| 2015/0373821 | A1 * | 12/2015 | Suzuki | H05G 1/025 378/62 |

FOREIGN PATENT DOCUMENTS

| | | | |
|---|---|---|---|
| JP | 2013101879 | A | 5/2013 |
| WO | 2013/069222 | A1 | 5/2013 |

* cited by examiner

RADIATION TUBE, RADIATION GENERATING APPARATUS, AND RADIATION IMAGING SYSTEM

BACKGROUND OF THE INVENTION

Field of the Invention

The present invention relates to a radiation tube, and a radiation generating apparatus and a radiation imaging system including the radiation tube, which can be used for medical equipment, a nondestructive inspection apparatus, and the like, for example.

Description of the Related Art

A radiation tube is used for accelerating, in a vacuum with a high voltage, electrons emitted from an electron source, and irradiating a target formed of a metal with the electrons to generate radiation such as X-rays. The high voltage applied in the radiation tube is required to be, for example, about 100 kV. When particulate foreign matter exists in vacuum space with a high electric field due to such a high voltage, discharge due to the foreign matter (foreign matter discharge) sometimes occurs. Foreign matter discharge is a phenomenon in which charged foreign matter in the radiation tube exchanges charge at a cathode and an anode and, while reciprocating with force applied thereto from the high electric field, stochastically discharges in collision with the cathode and the anode.

One origin of the foreign matter is foreign matter that enters the radiation tube in a process of assembling the radiation tube. Generation of such foreign matter can be reduced by washing members and an assembly jig and cleaning an assembly process environment. Another origin of the foreign matter is foreign matter separated from a member in the radiation tube, which is caused when the radiation tube is driven. For example, when the anode is irradiated with an electron beam during the drive of the radiation tube, a member inside the radiation tube is damaged by generated heat to be separated. Such separation can be inhibited by reconsidering drive conditions and structure design. As described above, measures for inhibiting entrance and generation of foreign matter can be taken. On the other hand, it is undeniable that, depending on instability of the process and fluctuations in drive conditions, foreign matter enters or is generated accidentally.

Japanese Patent Application Laid-Open No. 2013-101879 discloses a structure in which, by covering, with a dielectric, a joint portion between a tubular member forming the radiation tube and the cathode or the anode, electric field concentration that occurs at the joint portion is caused to be less liable to occur to inhibit discharge.

However, in the structure described above, foreign matter that enters or is generated in the radiation tube itself is not eliminated, and thus, there is still a possibility that foreign matter discharge occurs.

SUMMARY OF THE INVENTION

The present invention is directed to providing a radiation tube in which foreign matter discharge is reduced, and specifically, to efficiently trap foreign matter that enters or is generated in the radiation tube to reduce discharge due to the foreign matter. The present invention is also directed to providing a radiation generating apparatus and a radiation imaging system with high reliability using such a radiation tube.

According to one aspect of the present invention, there is provided a radiation tube, including: an insulating tube having a tubular shape; a cathode disposed at one end of the insulating tube; an anode disposed at another end of the insulating tube; a conductive member with an opening disposed in the radiation tube; and a dielectric disposed at at least one of an inside and an end of the conductive member.

Further features of the present invention will become apparent from the following description of exemplary embodiments with reference to the attached drawings.

DESCRIPTION OF THE EMBODIMENTS

Embodiments of the present invention are described in the following with reference to the attached drawings.

Figure 1A:
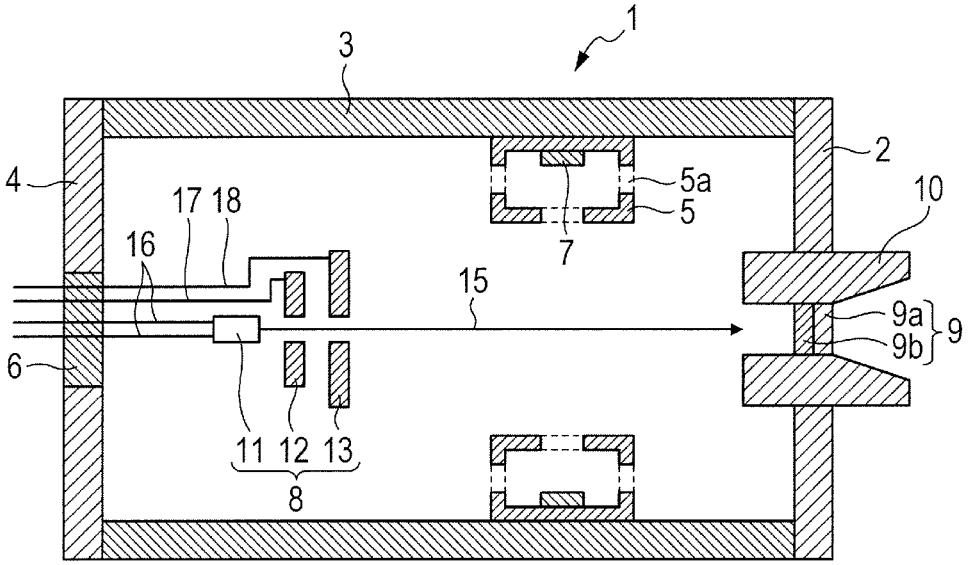
FIGS. 1A and 1B are sectional views each schematically illustrating the structures of a radiation tube according to embodiments of the present invention.

FIG. 1A illustrates the structure of a radiation tube according to an embodiment of the present invention.

A radiation tube 1 basically includes an anode 2 at one end and a cathode 4 at another end of a tubular insulating tube 3. An electron gun 8 includes an electron source 11, and a voltage is supplied to the electron source 11 via a wiring 16. The electron gun 8 further includes an extraction electrode 12 for extracting an electron beam 15 emitted from the electron source 11, and a lens electrode 13 for converging the electron beam 15. Potential at the extraction electrode 12 and potential at the lens electrode 13 are controlled by lines 17 and 18, respectively. The wirings 16, 17, and 18 pierce an insulating member 6 that is arranged so as to pierce the cathode 4 in a thickness direction to be extracted to an outside of the radiation tube 1.

The electron beam 15 emitted from the electron gun 8 is accelerated by a voltage applied between the cathode 4 and the anode 2 from a high voltage power supply (not shown) to collide with a target 9 mounted to the anode 2. The target 9 includes, inside a support substrate 9*a* formed of a material that passes radiation therethrough, a target layer 9*b* formed of a material that emits radiation through irradiation of an electron beam. The electron beam 15 enters the target layer 9*b* and thus radiation is emitted. The target 9 is mounted to a shield member 10.

As the material for the anode 2 or the cathode 4, there may be included, for example, Koval, a steel, an alloy steel, a SUS material, a metal such as Au, Ag, Cu, Ti, Mn, Mo, or Ni, or an alloy thereof. As the material for the insulating tube 3, there may be included, for example, so-called ceramic materials such as $Al_2O_3$ (alumina), $Si_3N_4$, SiC, AlN, or $ZrO_3$. However, any material may be adopted as long as the material has insulation property.

As the support substrate 9*a*, diamond, aluminum nitride, or silicon nitride, which has a radiation transmittance that is smaller than that of aluminum and has a thermal conductivity that is larger than that of tungsten, is preferred. The thickness of the support substrate 9*a* is not specifically limited insofar as the function described above can be performed and is preferably 0.3 mm or more and 2 mm or less, depending on the material. In particular, diamond has a quite large thermal conductivity, has a large radiation transmittance, and keeps a vacuum to a large extent, and thus, is more excellent than other materials.

As the target layer 9*b*, a metal material having an atomic number of 26 or more can be ordinarily used. A metal material having a large thermal conductivity and a high melting point is more preferred. Specifically, a metal material such as tungsten, molybdenum, chromium, copper, cobalt, iron, rhodium, or rhenium, or an alloy material thereof can be suitably used. With regard to the thickness of the target layer 9*b*, the optimum value varies because the depth of entrance of the electron beam 15 into the target layer 9*b*, that is, a region in which radiation is generated differs depending on an accelerating voltage, but the thickness is 1 μm to 15 μm. Integration of the target layer 9*b* with the support substrate 9*a* can be carried out by methods such as sputtering, evaporation, screen printing, jet printing, and the like. As another method, the target layer 9*b* having a predetermined thickness may be separately prepared by rolling or polishing and may then be subjected to diffusion bonding to the support substrate 9*a* under a high temperature and a high pressure.

The shield member 10 is a member that surrounds an outer periphery of the support substrate 9*a* and that protrudes to the radiation emission side (outside the radiation tube 1). Specifically, the shield member 10 has a passage therethrough in which both ends are open, and the target 9 is installed at an end of the passage on the electron gun 8 side or at some midpoint in the passage. The passage through the shield member 10 is a passage for introducing the electron beam 15 to an electron beam irradiation region of the target layer 9*b* on the electron gun 8 side with respect to the target 9, and is a passage for introducing radiation to the outside of the radiation tube 1 on the opposite side.

The shield member 10 is a member for blocking radiation. An unnecessary portion of radiation emitted from the target layer 9*b* is blocked by the shield member 10, and only a necessary portion of the radiation passes through the passage described above to be emitted to the outside of the radiation tube 1. The shield member 10 also has a function as a radiator. Heat generated by irradiating the target 9 with the electron beam 15 is dissipated via the shield member 10 to the outside. As the material forming the shield member 10, one having a high radiation absorptance is preferred from the viewpoint as a radiation shield member, and one having a high thermal conductivity is preferred from the viewpoint as a radiator. For example, a metal material such as tantalum or molybdenum can be used. Further, a combination of such a material having a high radiation absorptance and a material having a high thermal conductivity (for example, copper or aluminum) may also be used.

This embodiment is characterized by that the radiation tube 1 has a box-like conductive member 5 therein, which has at least one opening 5*a* that is exposed to inner space of the radiation tube 1, and the conductive member 5 has a dielectric 7 therein.

The inside of the conductive member 5 is free from an electric field, and thus, a metal or a metal oxide that is conductive is suitably adopted for the conductive member 5, and preferably a metal or a metal oxide having a conductivity of $1\times10^{-3}$ [S/m] to $1\times10^{8}$ [S/m] is used. Specifically, Kovar, a steel, an alloy steel, a SUS material, a metal such as Au, Ag, Cu, Ti, Mn, Mo, or Ni, an alloy thereof, or a metal oxide having the conductivity described above is used.

As the dielectric 7 arranged in the conductive member 5, a material having a relative dielectric constant of 8 to 10 is preferably used. Specifically, a so-called ceramic material such as $Al_2O_3$ (alumina), $Si_3N_4$, SiC, AlN, or $ZrO_3$ is used.

The opening 5*a* can be formed by machining or wet processing by etching a material such as a metal. The conductive member 5 may also be formed of a mesh formed by weaving a metal wire rod. In that case, openings in the mesh act as the opening 5*a* in the conductive member 5.

When foreign matter enters the conductive member 5, the inside of the conductive member 5 is free from an electric field, and thus, the foreign matter is not accelerated. Further, when charged foreign matter approaches the dielectric 7 arranged in the conductive member 5, charge of a polarity opposite to that of charge of the foreign matter is induced on a surface of the dielectric 7, an attractive force is exerted between the foreign matter and the dielectric 7, and thus, the foreign matter is trapped in the conductive member 5. Therefore, discharge due to foreign matter that enters or is generated in the radiation tube 1 is reduced.

Figure 5A:
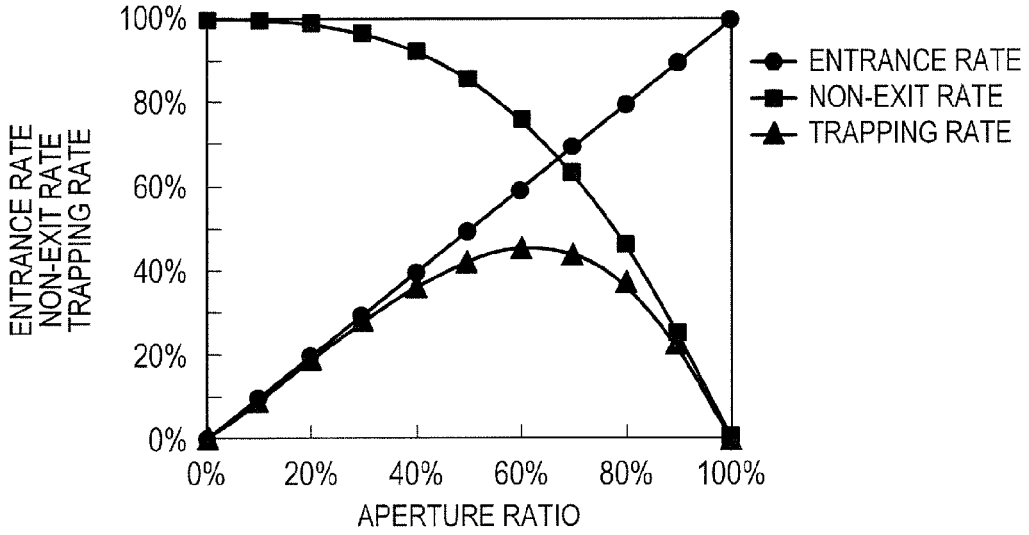
FIGS. 5A and 5B are graphs showing difference in trapping rate depending on an aperture ratio with regard to a conductive member according to the present invention and a conductive member having no dielectric provided therein, respectively.
Figure 5B:
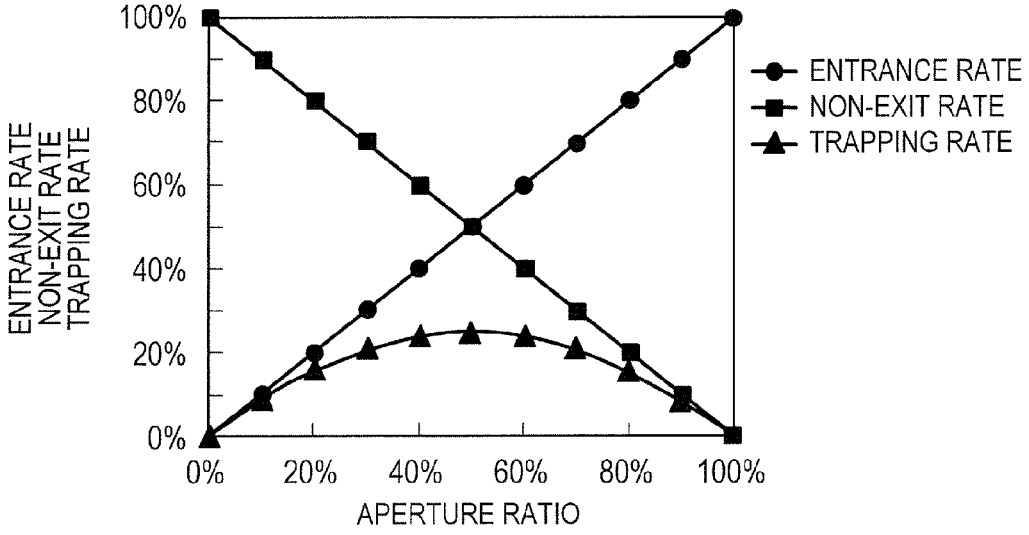

FIG. 5A is a graph showing the effect of trapping foreign matter in the radiation tube 1 when an aperture ratio of the opening 5*a* in the conductive member 5 is changed. As a comparative example, FIG. 5B is a graph showing the effect of trapping foreign matter in a radiation tube having the same structure as that of the radiation tube 1 illustrated in FIG. 1A with the exception that the dielectric 7 is not disposed therein. In FIGS. 5A and 5B, the abscissa indicates the aperture ratio of the opening 5*a* in the conductive member 5, and the ordinate indicates an entrance rate at which foreign matter in the radiation tube 1 enters the conductive member 5, a non-exit rate at which foreign matter that has entered the conductive member 5 remains in the conductive member 5 without going back into the radiation tube 1, and a trapping rate of foreign matter defined as a product of the entrance rate and the non-exit rate.

It is to be noted that, in the present invention, with regard to the aperture ratio of the opening 5*a* in the conductive member 5, a case in which the conductive member 5 does not have the opening 5*a* formed therein is assumed, and an outer surface area of the conductive member 5 exposed to inner space of the radiation tube 1 in such a case is assumed to be 100%. The ratio of an area of the opening 5*a* to the outer surface area is defined as the aperture ratio. Therefore, in the embodiment illustrated in FIG. 1A, a region of the conductive member 5, which is in contact with the insulating tube 3, is not included in the outer surface area of the conductive member 5.

As shown in FIG. 5B, when the dielectric 7 is not disposed, the entrance rate at which foreign matter enters the conductive member 5 via the opening 5*a* monotonously increases as the aperture ratio increases, and the non-exit rate monotonously decreases as the aperture ratio increases. Therefore, the trapping rate is a function having its peak when the aperture ratio is 50%. On the contrary, as shown in FIG. 5A, according to the present invention, while, similarly to the case of the comparative example, the entrance rate of foreign matter monotonously increases as the aperture ratio increases, the graph with regard to the non-exit rate is a curve in which, due to an effect of an attractive force exerted between the dielectric 7 and the charged foreign matter, the side of the larger aperture ratio has a larger non-exit rate.

Therefore, the trapping rate is, compared with that in the comparative example, higher over an entire range of the aperture ratio, and has its peak shifted to the side of the larger aperture ratio. According to the present invention, it is preferred that the aperture ratio be 40% to 85% so that the peak of the trapping rate is a center of the preferred range.

As described above, according to the present invention, a region free from an electric field is formed by the conductive member 5 in the radiation tube 1, and foreign matter that has entered the region can be efficiently trapped by the dielectric 7 to reduce discharge due to foreign matter in the radiation tube 1.

Figure 1B:
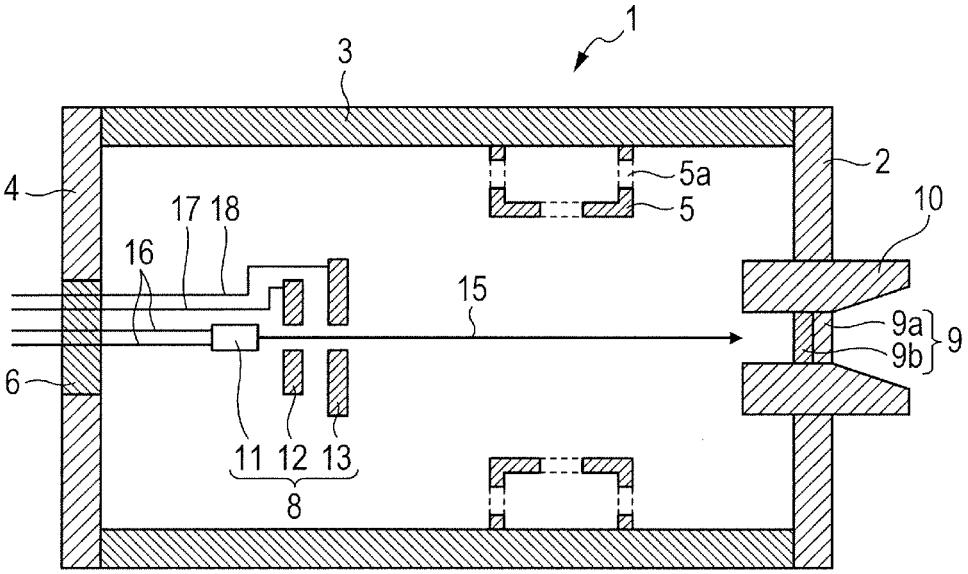

FIG. 1B illustrates another embodiment in which, similarly to the embodiment illustrated in FIG. 1A, the conductive member 5 is mounted to the inner side surface of the insulating tube 3, but, in the embodiment illustrated in FIG. 1B, an opening is formed in the conductive member 5 on the inner side surface side of the insulating tube 3. This exposes the inner side surface of the insulating tube 3 to the inside of the conductive member 5, and the inner side surface can act as the dielectric 7 for trapping foreign matter, which enables further simplification of the structure illustrated in FIG. 1A.

Figure 2A:
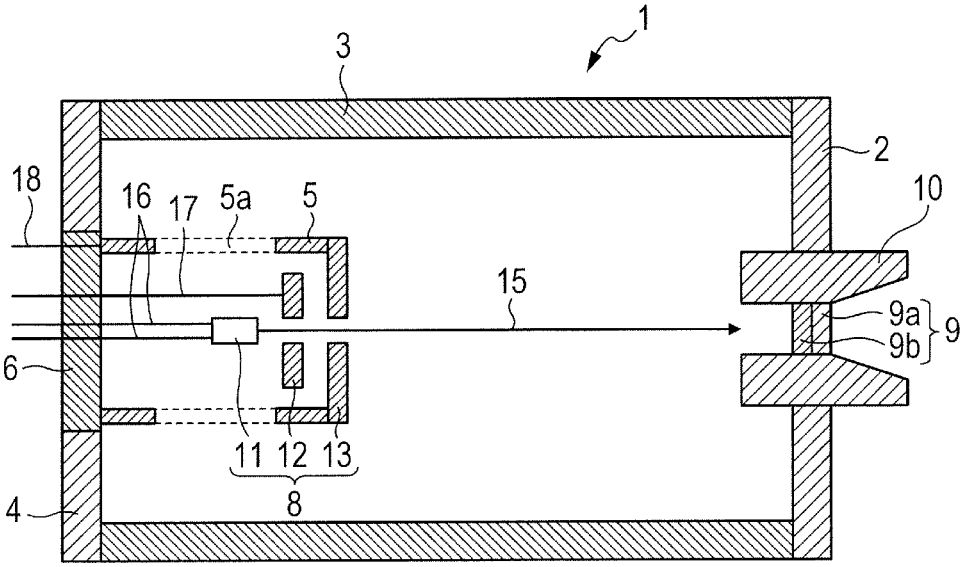
FIGS. 2A and 2B are sectional views each schematically illustrating the structure of a radiation tube according to other embodiments of the present invention.
Figure 2B:
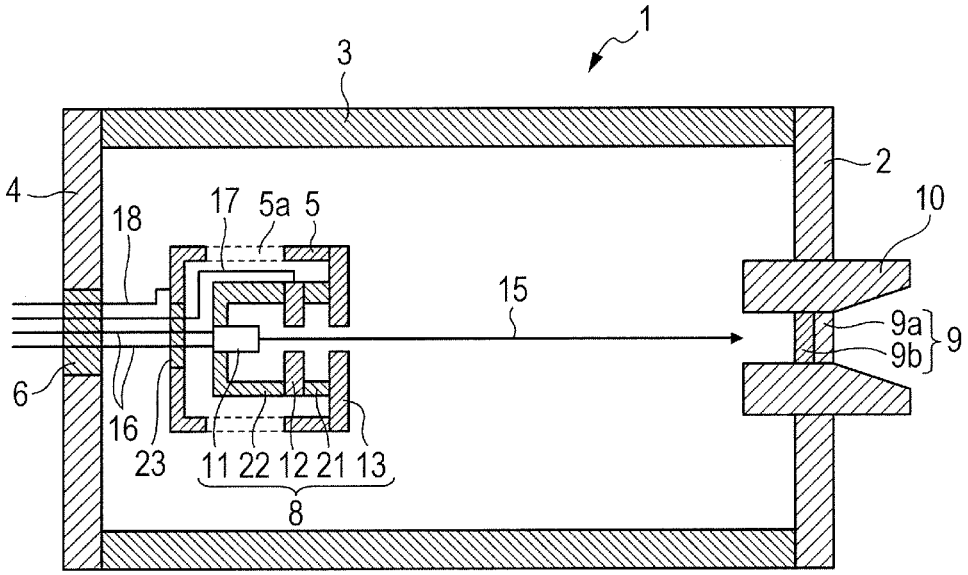

FIGS. 2A and 2B illustrate still other embodiments. FIG. 2A illustrates a case in which the insulating member 6 for wiring, which is arranged so as to pierce the cathode 4 for the purpose of leading the line 16 for supplying voltage to the electron source 11 outside of the radiation tube 1, is used as a dielectric for trapping foreign matter. In this embodiment, the conductive member 5 is formed so as to surround the electron gun 8. Further, the lens electrode 13 that is a component of the electron gun 8 also serves as a part of the conductive member 5.

It is to be noted that, with reference to FIG. 2A, the electron source 11, the extraction electrode 12, and the lens electrode 13, which form the electron gun 8, are fixed to the conductive member 5, the insulating member 6 for wiring, or the like by insulating support members (not shown), respectively. Therefore, the insulating support members can also be used as dielectrics for trapping foreign matter.

FIG. 2B illustrates an embodiment in which the electron source 11 and the extraction electrode 12 are joined to each other via an insulating electron source support member 22 and the extraction electrode 12 and the lens electrode 13 are joined to each other via an interelectrode support member 21. In this embodiment, the conductive member 5 is formed so as to surround the electron gun 8, the lens electrode 13 also serves as a part of the conductive member 5, and at least one of the electron source support member 22 or the interelectrode support member 21 can be used as a dielectric for trapping foreign matter. Further, in the structure illustrated in FIG. 2B, an insulating member 23 for wiring is arranged so as to pierce the conductive member 5, and the lines 16, 17, and 18 pierce the insulating member 23 for wiring to be led outside of the conductive member 5. This insulating member 23 for wiring can also be used as a dielectric for trapping foreign matter. It is to be noted that, in this structure, a surface of the insulating member 23 is included in the outer surface area of the conductive member 5 for calculating the aperture ratio.

Each of the radiation tubes 1 according to the present invention illustrated in FIGS. 1A, 1B, 2A, and 2B is a transmission type radiation tube in which radiation emitted from the target 9 passes through the support substrate 9*a* to be emitted to the outside, but the present invention can also be applied to a reflection type radiation tube in which radiation is emitted to the outside just like electrons are reflected by the target.

Figure 3:
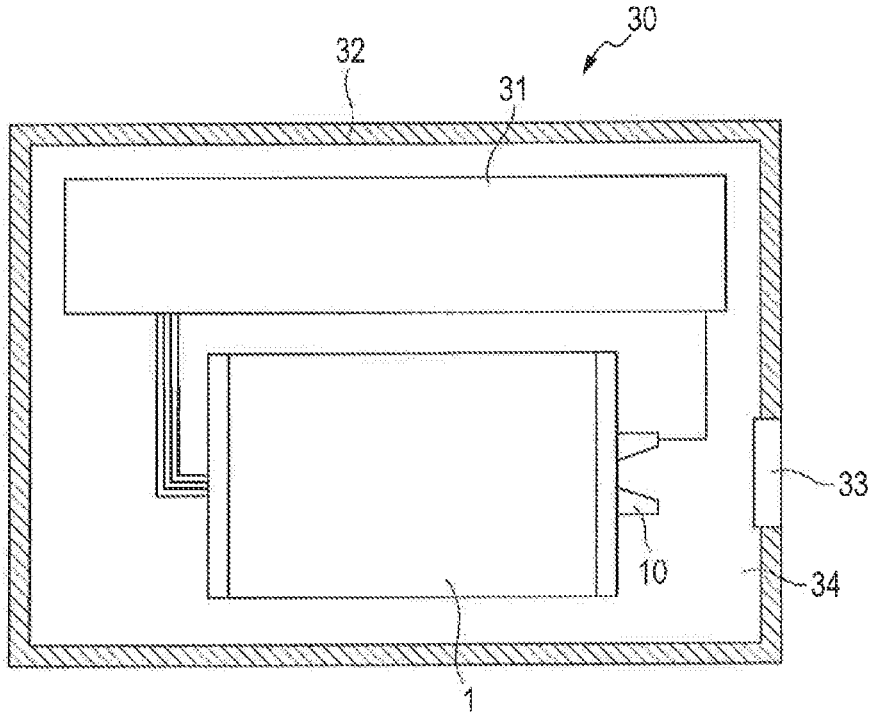
FIG. 3 is a sectional view schematically illustrating the structure of a radiation generating apparatus according to an embodiment of the present invention.

Next, a radiation generating apparatus according to the present invention is described. FIG. 3 is a schematic sectional view illustrating the structure of an example a radiation generating apparatus 30. The radiation generating apparatus 30 includes the radiation tube 1 described in the above embodiments and a storage container 32 for storing the radiation tube 1. Space left in the storage container 32 is filled with an insulating fluid 34 as a cooling medium.

A drive circuit 31 including a circuit board and an insulating transformer (not shown) may be provided inside the storage container 32. In the case where the drive circuit 31 is provided, for instance, a predetermined voltage signal is applied to the radiation generating tube 1 from the drive circuit 31 so that generation of the radiation can be controlled.

The storage container 32 only needs to have a strength sufficient for a container and is made of a metal or plastic material. The storage container 32 includes a radiation emitting window 33 that transmits a radiation so as to extract the radiation to the outside of the storage container 32. The radiation emitted by the radiation tube 1 passes through this radiation emitting window 33 and is emitted to the outside. The radiation emitting window 33 is made of glass, aluminum, beryllium, or the like.

As the insulating fluid 34, an insulating liquid, which has high electric insulation property and a high cooling ability and which changes in quality only to a small extent by being heated, is preferred, and, for example, an electrically insulating oil such as a silicone oil, a transformer oil, or a fluorine-based oil, a fluorine-based insulating liquid such as a hydrofluoroether, or the like can be used.

Next, a radiation imaging system according to an embodiment of the present invention is described with reference to FIG. 4.

The radiation generating apparatus 30 includes a movable diaphragm unit 35 provided at a part corresponding to the radiation emitting window 33. The movable diaphragm unit 35 has a function of adjusting a radiation field of radiation emitted from the radiation tube 1. In addition, it is possible to use the movable diaphragm unit 35 having an additional function to perform simulation display of the radiation field of the radiation using visible light.

A system control apparatus 42 controls the radiation generating apparatus 30 and a radiation detecting apparatus 41 in a coordinated manner. The drive circuit 31 outputs various control signals to the radiation tube 1 under control by the system control apparatus 42. With those control signals, radiation 36 emitted from the radiation generating apparatus 30 passes through a subject to be investigated 44 and is detected by a detector 46. The detector 46 converts the detected radiation into an image signal and outputs the image signal to a signal processing portion 45. Under control by the system control apparatus 42, the signal processing portion 45 performs predetermined signal processing on the image signal and outputs the processed image signal to the system control apparatus 42. The system control apparatus 42 generates a display signal for controlling a display apparatus 43 to display an image based on the processed image signal and outputs the display signal to the display apparatus 43. The display apparatus 43 displays an image based on the display signal as a photographed image of the subject to be investigated 44 on a display. A typical example of the radiation is an X-ray. The radiation tube 1, the radiation generating apparatus 30, and the radiation imaging system of the present invention can be used as an X-ray generating tube, an X-ray generating apparatus, and an X-ray imaging system. The X-ray imaging system can be used for nondestructive inspection of an industrial product or pathological diagnosis of a human body or an animal body.

EXAMPLES

Example 1

An experiment was conducted in which the radiation tube 1 illustrated in FIG. 1A was manufactured, a voltage of 100 kV was applied between the anode 2 and the cathode 4 by a high voltage power supply (not shown), and an electron beam was caused to collide with the target 9 with an electron current of 10 mA to generate radiation. A SUS material was used as the conductive member 5, and $Al_2O_3$ (alumina) was used as the dielectric 7. Further, a thermal cathode was used as the electron source 11, and the aperture ratio of the conductive member 5 was 65%. The result was that discharge did not occur in the radiation tube 1 and stable radiation irradiation was possible.

As a comparative example, the radiation tube 1 having the same structure with the exception that the dielectric 7 was not provided was manufactured, and a radiation generating experiment was conducted. When the applied voltage and the electron current were the same as those of Example 1, discharge sometimes occurred.

Example 2

An experiment was conducted in which the radiation tube 1 illustrated in FIG. 2B was manufactured, a voltage of 100 kV was applied between the anode 2 and the cathode 4 by a high voltage power supply (not shown), and an electron beam was caused to collide with the target 9 with an electron current of 10 mA to generate radiation. A SUS material was used as the conductive member 5, and $Al_2O_3$ (alumina) was used as the dielectric 7. Further, a thermal cathode was used as the electron source 11, and the aperture ratio of the conductive member 5 was 65%. The result was that discharge did not occur in the radiation tube 1 and stable radiation irradiation was possible.

Figure 4:
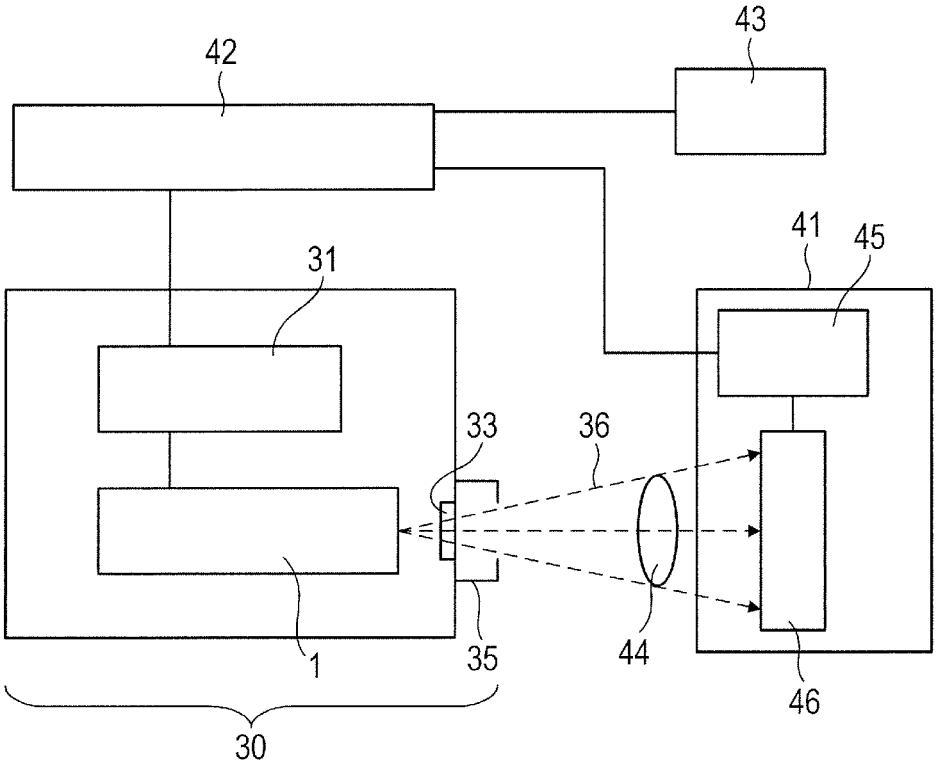
FIG. 4 is a block diagram schematically illustrating the structure of a radiation imaging system according to an embodiment of the present invention.

Further, the radiation generating apparatus 30 illustrated in FIG. 3 was formed using the radiation tube 1, and further, using this, the radiation imaging system illustrated in FIG. 4 was formed. Radiation imaging was performed under a state in which an electron accelerating voltage was set to be 100 kV. The result was that no discharge occurred and a satisfactory image was able to be taken.

According to the present invention, by trapping charged foreign matter that has entered or generated in the radiation tube by the dielectric when the foreign matter enters the conductive member, discharge due to the foreign matter can be reduced, and a radiation tube with high withstand voltage reliability can be provided. Further, using the radiation tube, a highly reliable radiation generating apparatus and a highly reliable radiation imaging system can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-005602, filed Jan. 16, 2014, which is hereby incorporated by reference herein in its entirety.

What is claimed is:

1. A radiation tube, comprising:
an insulating tube having a tubular shape;
a cathode disposed at one end of the insulating tube;
an anode disposed at another end of the insulating tube;
a conductive member with an opening disposed in the radiation tube; and
a dielectric disposed at at least one of an inside and an end of the conductive member.

2. The radiation tube according to claim 1, wherein an aperture ratio, which is a ratio of an area of the opening to an outer surface area of the conductive member when the outer surface area is assumed to be 100% in a case where the conductive member does not have the opening, is 40% to 85%.

3. The radiation tube according to claim 2, wherein the conductive member is mounted to an inner side surface of the insulating tube.

4. The radiation tube according to claim 3, wherein the conductive member has the opening on the inner side surface side of the insulating tube, and the inner side surface of the insulating tube exposed to the inside of the conductive member acts as the dielectric disposed in the conductive member.

5. The radiation tube according to claim 1, further comprising therein an electron gun for emitting electrons,
wherein the dielectric is disposed at a center portion of the cathode,
wherein a wiring for supplying voltage to the electron gun is led outside of the radiation tube through the dielectric, and
wherein the conductive member is disposed so as to surround the electron gun and the wiring.

6. The radiation tube according to claim 5, wherein the electron gun comprises an electron source, an extraction electrode, and a lens electrode, and the lens electrode is a part of the conductive member.

7. The radiation tube according to claim 1, further comprising therein an electron gun for emitting electrons,
wherein the conductive member is arranged so as to surround the electron gun,
wherein the dielectric is arranged at an end of the conductive member to the cathode side, and
wherein a wiring for supplying voltage to the electron gun is led outside of the conductive member through the dielectric.

8. A radiation generating apparatus, comprising:
the radiation tube according to claim 1; and
a container containing the radiation tube and having a radiation emitting window for extracting radiation generated by the radiation tube,
wherein space left in the container is filled with an insulating fluid.

9. A radiation imaging system, comprising:
the radiation generating apparatus according to claim 8;
a radiation detecting apparatus for detecting radiation emitted by the radiation tube and transmitted through a subject; and
a control apparatus for controlling the radiation generating apparatus and the radiation detecting apparatus in a coordinated manner.

10. A radiation tube, comprising:
an insulating tube having a tubular shape;
a cathode disposed at one end of the insulating tube;

an anode disposed at another end of the insulating tube;

an electron gun disposed in the radiation tube, the electron gun comprising an electron source, an extraction electrode, and a lens electrode;

an insulating member disposed so as to pierce the cathode;

wirings for supplying voltages to the electron source, the extraction electrode, and the lens electrode, respectively, the wirings being led outside of the radiation tube through the insulating member;

a first insulating support member for joining the electron source and the extraction electrode to each other;

a second insulating support member for joining the extraction electrode and the lens electrode to each other; and a conductive member with an opening disposed so as to surround the electron gun, and wherein an aperture ratio, which is a ratio of an area of the opening to an outer surface area of the conductive member when the outer surface area is assumed to be 100% in a case where the conductive member does not have the opening, is 40% to 85%.

11. The radiation tube according to claim 10, wherein the lens electrode is a part of the conductive member.

12. The radiation tube according to claim 11, wherein the electron source comprises a thermal cathode.

* * * * *